United States Patent [19]

Meisner et al.

[11] 4,091,612

[45] May 30, 1978

[54] ADJUSTING ARRANGEMENT FOR A DIGITAL INDICATOR

[75] Inventors: Alfred Meisner; Werner Arnold, both of Nuremberg; Peter Ennen, Allersberg, all of Germany

[73] Assignee: Firma DIEHL, Nuremberg, Germany

[21] Appl. No.: 721,467

[22] Filed: Sep. 3, 1976

[30] Foreign Application Priority Data

| | | |
|---|---|---|
| Nov. 9, 1975 | Germany | 2540486 |
| Jun. 6, 1976 | Germany | 2628794 |
| Aug. 16, 1976 | Germany | 2628899 |

[51] Int. Cl.[2] ..... G04B 27/00; G04C 3/00

[52] U.S. Cl. ..... 58/85.5; 58/23 R

[58] Field of Search ..... 58/16 R, 16 D, 16.5, 58/21.1, 21.11, 21, 23 AC, 85.5, 23 R

[56] References Cited

U.S. PATENT DOCUMENTS 3,987,616 10/1976 Castegnier ..... 58/85.5

*Primary Examiner*—Robert K. Schaefer
*Assistant Examiner*—Leonard W. Pojunas, Jr.
*Attorney, Agent, or Firm*—Burns, Doane, Swecker & Mathis

[57] ABSTRACT

An adjusting mechanism is disclosed for adjusting a digital indicator of an electronic mechanism, such as a timepiece, which includes a first pulse generating mechanism for normally operating the digital display indicator. A second pulse generator includes a pulse former connected electrically to the digital indicator for supplying electrical adjusting pulses thereto. A sensor is operably connected to the pulse former to deliver activating signals thereto for the production of an adjusting pulse. A pulse control member is operably associated with the sensor to control the delivery of activating signals to the pulse former. Either the sensor or the pulse control member is rotatable relative to the other such that activating signals are generated in response to such relative rotation and are generated at a rate which is proportional to the rotational speed of the pulse control member.

34 Claims, 17 Drawing Figures

FIG.8a
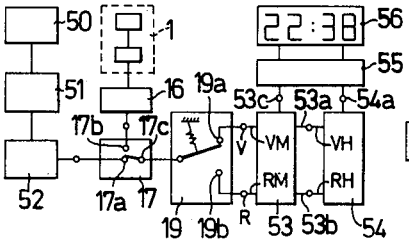
FIG.8b
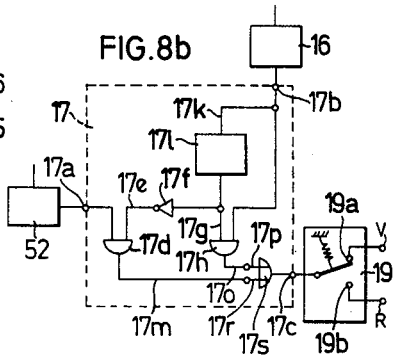
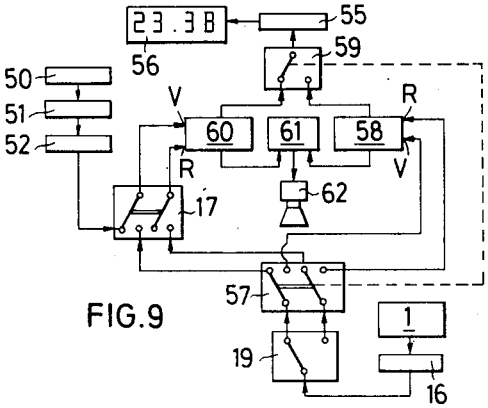
FIG.9
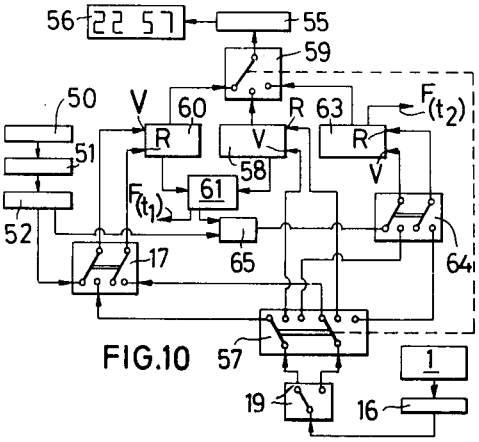
FIG.10
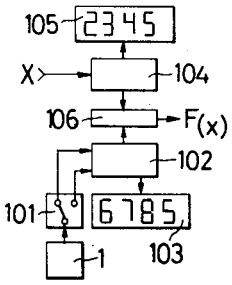
FIG.11

ADJUSTING ARRANGEMENT FOR A DIGITAL INDICATOR

BACKGROUND AND OBJECTS

The invention relates to an electromechanical adjusting system for an electronic digital indicator in an electronic device, especially a timepiece, of the type including a first pulse generator, an electronic counting mechanism with one or more counters for the digits, a indicator and setting arrangement operable by at least one operating element, and a second pulse generator through which time signals with a changeable pulse frequency can be produced in order to adjust the indicator.

An electromechanical setting or adjusting arrangement for an electronic digital indicator or recorder in an electronic watch has been known through Swiss Pat. No. 558,560. In this case, the correction or setting of the indicator can be accomplished by way of an operating element in the form of a turning knob accessibly disposed outside the watch housing. By shifting this turning knob, several outlets of a frequency divider with frequencies of various levels can be connected to the indicator within the watch by way of a contact spring disposed on a shaft. As a result, the indicator can be corrected as needed by various firmly fixed pulse frequencies. According to a variation of this arrangement, a separate RC or LC oscillator can be additionally provided, through the adjustment of which the frequency of the correcting pulses, which can be applied to the indicator, can be changed continuously and proportionally to the angle of rotation of the outside turning knob. Additionally, in the case of each of the above-mentioned embodiments of the indicator adjusting arrangement, means have been provided which make possible both a forward as well as a back adjustment of the indicator.

The two arrangements explained, now nevertheless require of the operating individual a very sensitive handling of the outside turning knob. This results from the fact that the frequency divider outlets that are to be approached in succession are very close to one another and, for another thing especially, because of the relatively limited turning angle which is available.

Therefore, it is an object of the invention to create an indicator adjusting arrangement which is simple and easy to handle without mistake in handling, and which can be used universally in electronic devices having an electronic digital indicator for the purpose of their adjustment.

BRIEF SUMMARY

The indicator-adjusting arrangement according to the invention makes possible in a particularly simple and absolutely error-free manner of handling, to correct and adjust the recording value on the electronic digital indicator in an electronic device by manual adjustment of an operating element, disposed outside said device, either in a forward or backward direction. The recording value can be changed by the development of the pulse generator in accordance with the invention through successive individual, separately defined correcting pulses following each other slowly or quickly, and produced in proportion to the rotating speed of the operating element, i.e., the faster the element is rotated, the faster the generation of pulses. This is guaranteed in accordance with the invention, in that adjustment does not depend upon positioning the operaing element in a specific angle or by effecting a rate of adjustment which requires a sensitive positioning of the operating element. Rather, in the present invention an electric adjusting pulse is established by each individual, mechanically defined unit of rotation of the operating element. By changing the rate of rotation of the operating element, the rate of adjustment of the digital indicator is correspondingly adjusted.

THE DRAWING

The invention is described in more detail on the basis of several embodiments shown in the drawing in which.

Figure 5A:
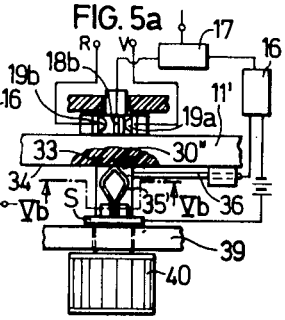
Figure 5B:
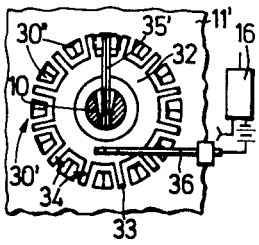

FIG. 5*a* is a schematic presentation of a fifth embodiment of the indicator adjusting arrangement according to the invention;

FIG. 5*b* is a sectional presentation taken along line V*b*—V*b* in FIG. 5*a;*

Figure 4:
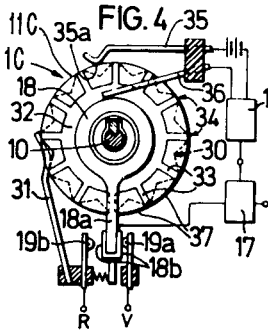
FIG. 4 is a schematic presentation of a fourth embodiment of the indicator adjusting arrangement according to the invention.
Figure 6A:
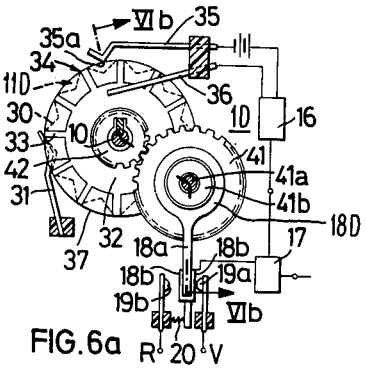
Figure 6C:
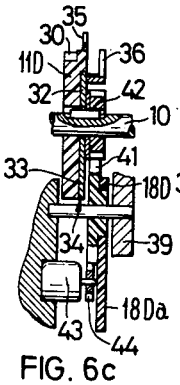
Figure 6B:
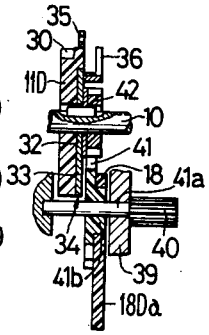

FIG. 6*a* is an indicator adjusting arrangement similar to that shown in FIG. 4 with a variation of the drive mechanism;

FIG. 6*b* is a sectional view taken along line VI*b*—VI*b* of FIG. 6*a;*

FIG. 6*c* is a variation of the drive for the indicator and adjusting arrangement shown in FIGS. 6*a* and 6*b* wherein a motor drive is provided.

Figure 7A:
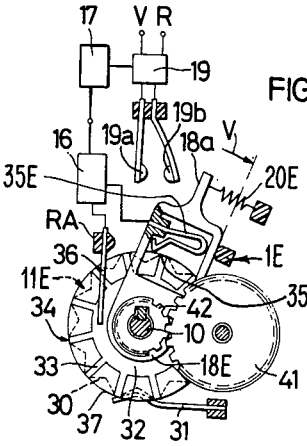
Figure 7B:
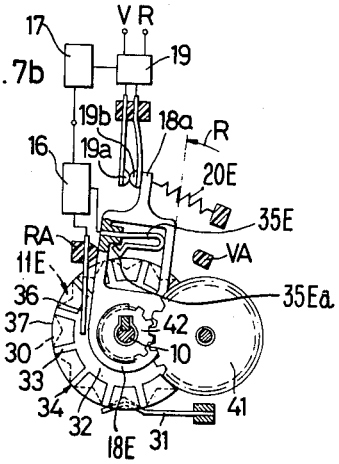
Figure 7C:
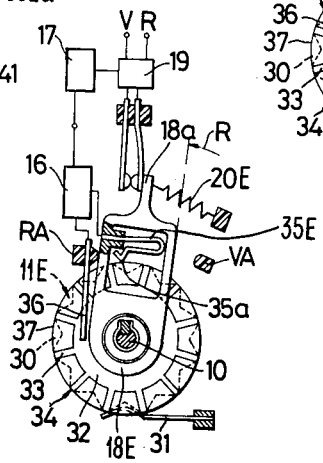

FIG. 7*a* is a variation of the indicator adjusting arrangement shown in FIGS. 4 and 6*a, b, c* in a position for a forward operation of the indicator;

FIG. 7*b* shows the indicator adjusting arrangement shown in FIG. 7*a* in a position for a backward operation of the indicator;

FIG. 7*c* shows the indicator adjusting arrangement shown in the FIGS. 7*a* and 7*b,* but with a modified driving arrangement;

FIG. 8*a* is a block switching diagram of an electronic watch with an electronic digital recording and with the indicator adjusting arrangement used according to the invention for the purpose of adjusting the digital indicator;

FIG. 8*b* is an embodiment of a signal path reversing switch according to the invention;

FIG. 9 is a block diagram of an electronic watch with an electronic digital indicator and an alarm arrangement and an indicator adjusting arrangement according to the invention;

FIG. 10 is a block diagram of a time switch device with an electronic watch and electronic digital indicator and the indicator adjusting arrangement according to the invention;

FIG. 11 is a block diagram of a device with a counting arrangement and an electronic digital indicator as well as an indicator adjusting arrangement according to the invention.

In the drawing, similar parts or parts which correspond to each other have been given the same reference numbers.

DETAILED DESCRIPTION

Figure 1:
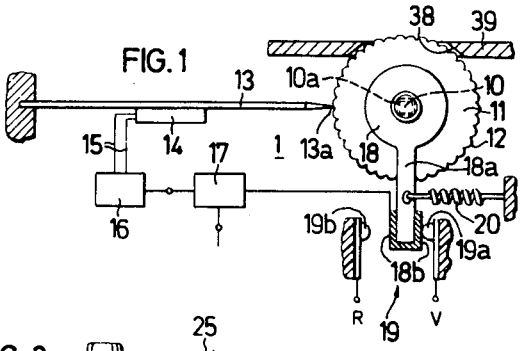
FIG. 1 is a schematic presentation of a first embodiment of an indicator adjusting arrangement according to the invention.

In the case of the indicator adjusting arrangement according to FIG. 1, a pulse generator 1 has been provided. The pulse transmitter or pulse control member of the generator comprises a pulse gear 11 which is seated with a slight rotational play of movement on a rotatably mounted driving shaft 10 by means of a polygonal driver key 10*a*. For the purpose of producing pulses, the gear 11 has a multiplicity of arc-shaped projections or cams 12 disposed successively around its periphery. A spring element is provided in the form of a metal leaf spring 13, which is clamped down at one end and which with its free end 13*a* is engageable with the cams 12 of the pulse gear 11. The spring element serves as a sensing element which can be deflected laterally by each cam upon rotation of the pulse gear 11.

A piezoelement 14 is attached as an impulse converter on said leaf spring 13. The two connections 15 of said piezoelement are connected to an electronic pulse former 16, which is connected to a reversing switch 17 for the signal path.

An indexing plate 18, frictionally seated on the driving shaft 10, cooperates with the pulse gear and has an extended shift finger 18*a*. On this shift finger, there are provided conductive contact surfaces 18B which are electrically connected with the reversing switch 17 for the signal path. By rotating the pulse gear 11, the finger 18*a* can be shifted between two contacts of a forward-backward reversing switch 19, namely between a contact 19*a* for the forward operation of the indicator and a contact 19*b* for the backward operation of said indicator, as will be later discussed. As a result of a restoring element 20, which is developed as a tension spring and engages the shift finger 18*a* of the indexing plate 18, the signal path to the indicator is continuously connected for forward operation thereof, i.e., one contact surface 18*b* on the shift finger 18*a* is biased into contact with the contact 19*a* for forward operation of the forward-backward reversing switch 19, and the recording control signals leave the forward-backward reversing switch 19 by way of its forward outlet V. If, however, the shift finger 18*a* with a contact surface 18*b* engages the contact 19*b* for the backward operation of the forward-backward reversing switch 19, then the outlet control signals leave the latter by way of its backward outlet R.

Rotation of the gear 11, as through manual frictional engagement thereof causes the sensing element to be deflected by the cams 12. Each deflection causes the piezoelement 14 to send a single activating signal to the pulse former 16. The location of the element 18 determines whether the indicator is adjusted forwardly or backwardly. Thus, if the shaft 10 is rotated clockwise, the element 18*b* contacts the contact 19*b* for reverse adjustment of the indicator. The relative play between the gear 11 and the shaft 10 enables the element 18*b* to engage the contact 19*b* before adjusting pulses are created by the pulse former 16. Subsequently, the shaft 10 rotates relative to the plate 18, due to the frictional connection therebetween as the element 18*b* continues to contact the contact 19*b*. Each time the sensor 13 is flexed by the cams 12, the end of the sensor engages the indent ahead of the next cam to resist further rotation. Therefore, individual, mechanically defined units of movement of the gear are defined. It will be realized that the rate of adjustment of the indicator is altered by varying the rate of rotation of the gear 11.

Figure 2:
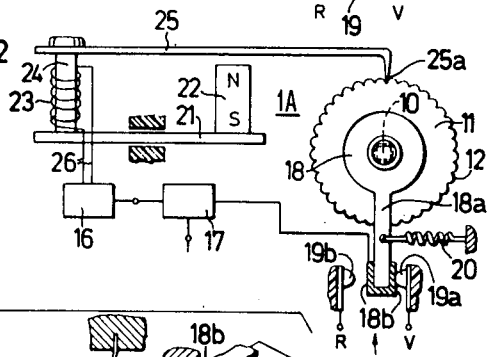
FIG. 2 is a schematic presentation of a second embodiment of an indicator adjusting arrangement according to the invention.

In the case of modified indicator adjusting arrangement 1A according to FIG. 2, and with the arrangement otherwise remaining the same as in FIG. 1, an electromagnetic pulse converter element has been provided instead of a piezoelectric pulse converter, the remaining arrangement corresponding to that shown in the embodiment in FIG. 1. The electromagnetic pulse converter element comprises a conductive yoke plate 21 on which a permanent magnet 22, as well as a coil 23 with an iron core 24, has been disposed. The magnet 22 is spaced laterally of said permanent magnet. At the upper end of the core 24 one end of a metallic arm or armature 25 is clamped, serving as a sensor element and developed in the form of a leaf spring. The other, free end 25*a* of the armature 25 engages the pulse gear 11. In the case of rotation of the gear 11, the armature can be radially inclined. The two coil connections 26 are coupled to the pulse former 16.

Figure 3:
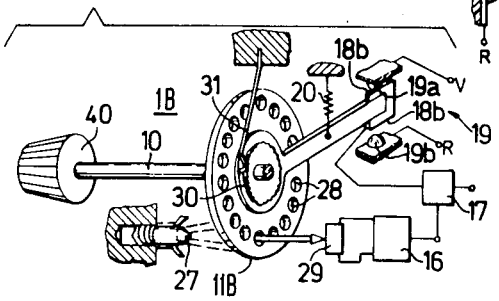
FIG. 3 is a schematic presentation of a third embodiment of the indicator adjusting arrangement according to the invention.

In the case of the further embodiment shown in FIG. 3 of the indicator adjusting arrangement of the invention, the pulse generator 1B has been constructed as a light barrier. The pulse control member or pulse gear 11B is developed as a perforated disc with a multiplicity of pulse producing elements in the form of holes 28 irradiated by a light source 27. The holes 28 are arranged in a circular pattern. A photoelement 29 comprises a sensing element in the form of a pulse converting element which cooperates with the light source 27. The two connections of the photoelement 29 are conducted to the pulse former 16. In that case, a standard light bulb may serve as a source of light. Beyond that, a stop toothing 30 in the form of a star wheel is connected for rotation with the pulse gear. A stop spring 31 engages with the tooth wheel 30 in such a way, that in the case of a resting pulse gear the ray of light is directed between two spatially adjacent pulse producing holes 28. The further arrangement corresponds to the structure shown in FIG. 1. When the holes 28 are aligned with the light, the light becomes operably connected with the pulse former to activate same.

In the case of a further embodiment of the indicator adjusting arrangement shown in FIG. 4, a pulse generator 1C has been provided in the case of which the pulse control member or pulse gear 11 comprises insulating material, predominantly of wear resistant plastic. Within the body of the gear, an electrically conductive contact ring 32 has been molded. The ring 32 includes a multiplicity of electrically conductive contact lamellae 33 placed on it in the form of a star. The lamellae 33 extend radially outward to the smooth peripheral surface of the pulse gear 11C and there form contact surfaces 34 with their outwardly facing cross-sectional surfaces being disposed for the production of intermittent electric pulses upon rotation of the pulse gear. In this case, a contact spring 35 constantly contacting the smooth peripheral surface of the pulse gear 11C has been provided as a sensor element. At the pointed tip 35*a* of the spring 35, the contact surfaces of the pulse gear can glide against the spring 35 free of chatter when the gear is rotated. A spring 36 has a free end frictionally engaging the side of the ring 32. The contact spring 35 as well as a contact spring 36, are able to close an electric circuit for a pulse transmission to the pulse former 16. The springs 35, 36 are in the form of leaf springs, the ends of which are electrically connected with the pulse former 16. Also, as in the case of the previously described pulse gear generator 1B, a stop toothing 30 is connected with the gear 11C for the purpose of releasably fixing its rotational position. A stop spring 31 disposed at one end firmly in the frame engages the tooth wheel 30 in such a way that the tip 35*a* of the contact spring 35 lies between two spatially adjacent pulse producing contact surfaces 34 and engages an insulating part 37 of the peripheral gear surface when the pulse gear 11 rests. The pulse gear is seated on the rotatable driving shaft 10; however, instead of a key, a driver wedge disposed in a groove of the driving shaft 10, has been provided as a driver, which driver wedge engages with an axial groove of the pulse gear 11C. In order to prevent a multiple pulse transmission in the case of rotating a contact surface past the tip 35*a* of the contact spring 35, a rotatory play exists between the driving shaft 10 and the pulse gear 11 which is predetermined by the driver wedge being formed somewhat narrower in its width as compared to the width of the groove and which has an angular size which is slightly above half the rotational angle between two adjacent stop positions of the pulse gear 11. The arrangement of the remaining construction units shown in this figure again corresponds to the configurations shown in FIG. 1.

In the case of the indicator adjusting arrangement according to FIGS. 5*a* and 5*b*, the contact ring 32 with the contact lamellae 33 is not molded into a rotatably mounted pulse gear, but in a fixed insulating plate 11'. Instead of a locally fixed contact spring 35, now a contact spring 35' has been provided, which is attached to the rotatable driving shaft 10' and which can be rotated together with said shaft relative to the fixedly arranged contact surfaces 34' of the ring for the purpose of producing a pulse. In this regard, the spring 35 includes a laterally extending tip which is able to contact the conductive surfaces 34' of the ring 32. Beyond that, a slip ring S, electrically connected to the pulse former 16 and against which the contact spring 35' continuously engages with a resilient tip, have been provided. Also provided is a stop toothing 30', the individual stop indentations 30'' of which being disposed between the individual contact lamellae 33. An additional stop spring is not needed, since in the case of this embodiment, its function has been taken over at the same time by the contact spring 35'. Rotation of the drive shaft 10' tends to produce rotation of the spring 35'. However, the latter is free to bend due to being engaged in the indentations 30''. Therefore, a certain amount of rotation of the shaft 10' is necessary before the spring 35' rotates. The rest of the arrangement, including especially the indexing plate 18, the contacts 19*a* and 19*b* of the forward-backward reversing switch 19, as well as the contact spring 36 fitting against the contact ring 32, corresponds generally to the embodiment shown in FIG. 4.

The drive of the pulse gear 11 can be accomplished directly without interposition of a special operating element. The pulse gear 11, of FIG. 1, is accessible externally of the housing through an opening 38 in a housing wall 39 of an apparatus and can be manually operated directly by way of the extended cams which, at the same time and additionally, serve as gripping elements for a finger of the operator. A similar arrangement can be provided for the FIG. 2 mechanism.

Furthermore, however, the driving shaft 10 could be guided through the housing wall 39 to the outside and can there be connected with a turning knob 40 for the operation of the pulse gear 11B, 11C or 11' (FIGS. 3, 4, 5*a*). In the FIG. 5*a* embodiment, rotation of the shaft 10 produces rotation of the contact spring 35'.

It is also conceivable, however, to form cams on the perforated plate 11B (FIG. 3) outside, serving as gripping elements, or else in the case of the pulse gear of FIG. 4, to make the stop toothing 30 larger in its diameter than the pulse gear 11C and to dispose the stop toothing outwardly of the housing in the manner shown in FIG. 1 in connection with the gear 11.

It is also possible (see FIGS. 6*a* and 6*b*) to interpose a transmission gear assembly 41, 42 between the pulse gear 11D and the turning knob 40 (or between the spring 35' and the knob 40 in FIG. 5*a*) in order to increase the number of pulse transmissions. The driving gears 41 and 42 intermesh mostly with play. The first gear 41 at the same time is seated on the same shaft 41*a* as the turning knob 40 and it carries on a molded-on driver bushing 41*b* the frictionally drivable indexing plate 18. The second gear 42 is seated in the same manner as the pulse gear 11D on the driving shaft 10 secured for driving; however, it can possibly also be molded-on to the pulse gear 11D. The required play will result from the play of the gears between the two gears 41 and 42.

As shown in FIG. 6*c*, it is moreover possible to provide the previously described transmission gear assembly additionally with a servo motor 43 having a pinion connected to the gear 41. The adjusting arrangement or shifting speed can be varied by way of adjusting knob etc., not shown, and seated outside the housing.

By rotating the gears 11, 11B, 11C, 11' one incremental turn, and impulse signal is generated. Each incremental turn is established by the stop spring, e.g., 13, 25, 31, 35, 35' to provide a physical indication to the operator where an incremental turn has been made.

In FIGS. 7*a* and 7*b*, a variation of the indicator adjusting arrangement based upon FIGS. 4, 6*a* and 6*b* is shown. For the drive of the pulse gear 11E, the transmission gear assembly of the previously described type has been provided. The indexing plate 18E is frictionally mounted on a bearing member (not visible in the drawing) molded onto the gear 42. Beyond that, the contact spring 35E serves as a sensor element and is not fixed in the frame but is rather attached to the indexing plate 18E. The indexing plate 18E is somewhat enlarged in its spatial extent as compared with FIG. 1 and can be swiveled between two stops disposed in a locally fixed manner, namely a forward stop VA and a backward top RA. The swiveling angle of the indexing plate 18E with the contact spring 35E attached thereon has been predetermined at the same time by the distance of the two stops; it is greater than half and smaller than the full angle between two adjacent contact surfaces 34 on the pulse gear. Between the gear 11E and the shaft 10, and thus between the indexing plate 18E and the pulse gear 11E, there is a driving play which makes possible a relative movement of the two parts at least by an amount corresponding to the swiveling angle between the two stops. As a result of this play, one can achieve within the swiveling angle a swiveling of the indexing plate 18E with the contact spring 35E attached thereon, leading the rotation of the pulse gear 11E in the direction of adjustment. Moreover, as noted previously in connection with FIGS. 4 and 5*a*–5*b*, when a stop tooth 30 passes the tip of the stop spring 31, the latter engages the rear side of the tooth and urges it forwardly. Since the gear 11E can rotate relative to the shaft 10 (i.e., via the play therebetween), the spring 31 advances the gear 11E faster than the shaft 10 rotates. Thus, it is assured that the next adjusting pulse will be created.

The forward-backward reversing switch 19, shown in the FIGS. *7a* and *7b* as well as *7c*, has a construction which has been modified as compared to that of the FIGS. 1 to 6 and which for that reason is based also on a different switching function, namely that of a switching ON-OFF switch, instead of a reversing switch. Its two contacts 19*a* and 19*b* lie in the swiveling path of the shift finger 18E*a* molded onto the indexing plate 18E and can be closed by said finger upon swiveling of the indexing plate 18E from the forward stop VA to the backward stop RA (FIG. *7b*).

FIG. *7a* shows all previously described mechanical and electrical contruction units of this indicator adjusting arrangement in a position for the forward operation of the indicator. In that case, the pulse gear 11E is at rest, with the indexing plate 18E at the same time being biased under the action of the tension spring 20E against the forward stop VA. The two contacts 19*a* and 19*b* of the forward-backward reversing switch 19 are opened — the switching path to the indicator has been set for forward operation.

FIG. *7b* shows the indexing plate 18E in a position swiveled to the backward stop RA for backward operation of the indicator. In the case of a swiveling of the indexing plate 18E from the stop VA to the stop RA, the two contacts 19*a* and 19*b* of the forward-backward reversing switch 19 are closed, as a result of which the switching path is set for a backward operation of the indicator. The further construction of the arrangement shown in the two FIGS. *7a* and *7b* corresponds to that according to FIG. 6 and therefore needs no further explanations, except to note that the frictional mounting of the plate 18E allows the shaft 10 to be further rotated for creating adjusting pulses.

The arrangement to FIG. *7c* also agrees to the farthest extent with the embodiment shown in FIGS. *7a* and *7b*. In this case, the use of a transmission gear for the drive of the pulse gear 11 has been omitted.

In FIGS. 8 to 11, there are respectively proposed several possibilities of application of the indicator adjusting arrangement according to the invention in electronic devices, namely in an electronic watch (FIG. 8), in an electronic watch with alarm arrangement (FIG. 9), in a time switch device (FIG. 10), as well as a device with a counting arrangement (FIG. 11).

In the case of an electronic watch according to FIG. 8, a frequency standard 50, a frequency divider 51 and a seconds counter 52, connected with the latter, have been provided. These components form a pulse generator which operates the digital indicator during its normal time-keeping function. The counter 52 is connected with the first inlet 17*a* of the electronic signal path reversing switch 17. A second inlet 17*b* of the signal path reversing switch is connected with the pulse former 16 driven by the pulse generator 1, 1A, 1B, 1C, 1D, 1E. The signal path reversing switch 17, in turn, is connected by way of electric connection with its outlet 17*c* to the forward-backward reversing switch 19. A minute-forward-backward counter 53 is connected with the forward outlet V of the forward-backward reversing switch 19 by way of a forward inlet VM, and with the backward outlet R of the forward-backward reversing switch 19 by way of a backward inlet RM. A forward outlet 53*a* of this minute forward-backward counter 53 is connected with a forward inlet VH and a backward outlet 53*b* is connected with the backward inlet RH of an hour-forward-backward counter 54. An additional outlet 53*c* and the counter 53 as well as an outlet 54*a* of the counter 54 is coupled with a decoder 55. This is connected in series, as the last member of the indicator control circuit, with an electronic digital display indicator arrangement 56 in the form of an LCD or LED indicator with seven-segment-presentation of the numbers.

FIG. 8*b* shows an embodiment for the signal path reversing switch 17. The first inlet 17*a* of the signal path reversing switch 17, shown within the broken line, coincides with a first inlet of a first AND page 17*d*, the second inlet 17*e* of which is connected by way of an inverter 17*f* with a first inlet 17*g* of a second AND gate 17*h*. The second inlet 17*b* of the signal path reversing switch 17 coincides with the second inlet of the second AND gate 17*h*, whereby a switching-off delaying circuit 17*l* has been provided in a connecting branch 17*k* between the two inlets 17*b* and 17*g* of the second AND gate 17*h*. An outlet 17*m* of the first AND gate 17*d* as well as a second outlet 17*o* of the second AND gate 17*h* are joined always with an inlet 17*p* or 17*r* of an OR gate 17*s*, the outlet of which coincides with the outlet 17C of the signal path reversing switch 17 which is connected with the forward-backward reversing switch 19.

When using an indicator adjusting arrangement according to the invention in an electronic watch with an alarm system (FIG. 9), the pulse former 16, the forward-backward reversing switch 19, and a second signal path reversing switch 57 are connected in series to the pulse generator 1 or 1A–1E. The second signal path reversing switch 57 is connected on the one hand with the signal path reversing switch 17 subsequently called the first signal path converting switch, and on the other hand with a storage 58 for storing the wake-up time, comprising an hour and minute forward-backward counter. Beyond that, an indicator reversing switch 59 preceding the decoding arrangement 55 has been provided which, on the one hand, is coupled with a time counter 60, comprising a hour and minute forward-backward counter and, on the other hand, with the storage 58, and by which selectively the time of day or the time of waking up can be shown on the electronic digital indicator 56. This indicator reversing switch 59 is, as shown in the drawing in broken lines, coupled with the second signal path reversing switch 57, so that a reversal of the latter will produce a reversing of the indicator reversing switch 59 automatically. In addition, a comparator 61 is connected electrically with the storage 58 for the waking up time and with the time counter 60 for the time of day, which comparator 61, in turn, can be connected electrically with an alarm arrangement 62 as a result of agreement of the time of day and of the stored waking up time.

FIG. 10 shows the use of the indicator adjusting arrangement according to the invention in a time switch device, whereby the block diagram of the electronic watch, with alarm arrangement according to FIG. 9, has been utilized for this purpose and has merely been supplemented by various additionally needed construction elements or groups.

The storage 53 shown in FIG. 9 for storing the waking up time designated subsequently as the first storage, in this case serves for storing the beginning or the end of the course of a function, e.g., a cooking process. A second storage 63, consisting of an hour and minute forward-backward counter, serves for the storage of the duration of this course of function. A third signal path reversing switch 64 is connected electrically, on the one hand, with the second storage 63 and, on the other hand, with the second signal path reversing switch 57 by way of two additional outlets. Moreover, the third signal path reversing switch 64 is connected with the seconds counter 52 by way of a first inlet of a gate circuit 65. The second inlet of the gate circuit 65 is connected to the comparator 61, so that the latter in the case of agreement of the time of day with the point in time adjusting in the first storage 58, produces a signal for putting through the time signal to the second storage 63, whereby said signal at the same time also serves as a switching signal $F_{(t1)}$ for the triggering of the progress of a function. As a result of the second storage 63, and after termination of the adjusted period of time, a switching signal $F_{(t2)}$ (i.e., the ON–OFF, or alarm signal) can be delivered. The second storage is also connected via a feed line with an additional input assigned to an additional switching position with the recording reversing switch 59, so that now the duration of said progress of the function can also be shown on the electronic digital indicator 56 beside the time of day, the period in time of the beginning or the end of the progress of the function.

In the case of using the indicator adjusting arrangement of the invention in a device with a counting mechanism (FIG. 11), a forward-backward reversing switch 101 as well as a theoretical value storage 102 is connected in series with the pulse generator 1 or 1A–1E. The contents of said storage can be adjusted by a shifting of the pulse gear while simultaneousy making the input value visible on the electronic digital recording arrangement 103. Beyond that, a storage 104 for the actual value has been provided the contents of which resulting from incoming pulses $x$ can be shown on an actual value recording 105 or selectively also on the electronic digital recording arrangement 103. Beyond that, a comparator 106 has been disposed in the case of this arrangement between the actual value and the theoretical value storage, which comparator in the case of agreement of the contents of both storages is capable to deliver a switching signal $F_{(x)}$.

Subsequently, the function of the indicator adjusting arrangement of the invention is shown in cooperation with the devices of the previously described four embodiments.

By operating the pulse gear 11 according to FIGS. 1 to 4, as well as 6*a* to 7*b* or of the sensor element 35' according to FIGS. 5*a* and 5*b*, either directly or indirectly by way of a turning knob, with or without transmission gearing, in the direction for forward operation of the recording, the following effect will occur in the case of the embodiments of the above-mentioned figures, individually observed by themselves.

By counterclockwise rotation of the pulse gear 11 according to FIG. 1, the leaf spring 13, with the piezoelement 14 attached thereto, is always inclined tangentially with respect to the cams 12 of the pulse gear 11 whereby it bends in response to rotation. After exceeding the highest point of one cam, the leaf spring 13 springs back again into its starting position and there strikes against the flank of the next cam, resisting further rotation. As a result of this inclining and rebounding process, the piezoelement is shaken to such a point that a voltage pulse is produced. This voltage pulse is conducted to the pulse former 16 and is conducted to the indicator 56 by way of the signal path reversing switch 1, which has been previously switched to correcting operation, as well as by way of the previously explained components (e.g., components 53, 54 and 55 in FIG. 8*a*) to the indicator, where it causes a charge of one unit in the recorded value in a positive sense.

The signal paths of the individual elements of the signal path reversing switch 17, shown in FIG. 8*b*, are switched at the same time in such a way, that during an adjusting phase of the indicator, no time signals derived from the frequency standard 50 are recorded, but only adjusting pulses produced by the indicator-adjusting arrangement can be supplied to the indicator. As a result of the switching off-delaying circuit 17*l*, a short time after the last correcting pulse has been made, the system automatically switches back to the time pulse derived from the frequency standard 50.

The speed of change or of adjustment for the indicator depends on the number of cams on the periphery of the pulse gear or its operational speed, since every inclination of the leaf spring 13 by a cam 12 and its rebound to the next cam delivers an indicator adjusting pulse.

The function of the arrangements according to FIGS. 2 and 3 is the same in principle as that according to FIG. 1. Subsequently, therefore, the essential differences will be emphasized.

The armature 25 according to FIG. 2 is always deflected radially by one of the cams 12 on the pulse gear 11 when the latter is rotated and it falls, after exceeding a maximum cam point, into the slot between two cams. This falling action can be accelerated by the rotary play of movement in the positive connection between the driving shaft 10 and the pulse gear 11. In the case of each movement of inclination of the armature 25, a voltage is induced in the coil 23 which is inverted in the pulse former 16 into an indicator-adjusting pulse and which is recorded in the previously described manner.

In the case of the arrangemet according to FIG. 3, the ray of light emitted by the light source 27 in the direction of the photoelectric cell 29 is interrupted in the rest position of the pulse gear 11B. In case of rotation of the pulse gear, the ray of light can penetrate through one of the holes 28 and can reach the photoelectric cell. There, the occurring light energy is converted into electric energy for one indicator-adjusting pulse and is passed on by way of the pulse former 16 in the previously described manner to the indicator.

In the case of rotation of the pulse gear 11C, shown in FIG. 4, the pulse gear 11D of FIGS. 6*a*, 6*b*, 6*c* and the gear 11E of FIG. 7*a* for the purpose of a forward correction of the indicator, a circuit to the pulse former 16 is closed for a short time during the time of contacting of one of the contact surfaces 34 on the pulse gear 11 as a result of the tip 35*a* of the contact spring 35 by way of the slip ring 32 and the contact spring 36 biased against it. These signals are converted into digital switching signals in the pulse former and are passed onto the indicator in the same manner as has already been described by way of the subsequent components (FIGS. 8–11).

The production of pulses for the purpose of adjusting the indicator in FIGS. 5*a*, 5*b* is the same in principle as that of FIG. 4, there being only a slight difference in design of the structure.

If, in the case of an adjusting and correcting process, a desired indicator value has been passed, then according to the invention, it is possible in the most simple manner to correct this mistake by operating the pulse gear merely in the opposite direction. In the case of a backward correction, the effects described subsequently will occur in the case of the individual embodiments. In the case of backward rotation of the pulse gears described in FIGS. 1–4 and 6*a, b, c,* or of the contact spring 35' (FIGS. 5*a* and 5*b*), first of all the switching plate 18 with its shift finger 18*a* is swiveled away from the contact 19*a* for forward operation in the forward-backward reversing switch 19 and toward the contact 19*b* for backward operation of the indicator. As a result, the switching path in the forward-backward reversing switch 19 is switched to backward operation of the indicator. During this swiveling process, the pulse gear of FIGS. 1 to 4, because of the existing rotary play, is still in rest position. Only in case of further twisting of the pulse gear 11 are pulses again produced as a result of the pulse producing elements and are conducted to the indicator in the same manner as in the case of the forward adjustment of the indicator. However, the components are reversed now in accordance with the backward operation so the recording value of the indicator is reduced one unit by each pulse. In the FIG. 5*a,* 5*b* embodiment, there is a play of movement between the shaft 10' and the spring 35' by the latter's ability to flex. There is thus required a prescribed amount of rotation of the gear 11' before a pulse is generated.

For a backward correction of the indicator according to FIGS. 7*a* and 7*b* by operation of a rotating knob, not shown, the indexing plate 18E, seated frictionally on a bearing of the gear 42, is swiveled by way of the driving gears 41 and 42 from the position shown in FIG. 7*a* for the forward operation into the position shown in FIG. 7*b* for backward operation of the indicator and engages the backward stop RA. At the same time, as a result of the shift finger 18E*a* disposed on the indexing plate, the contacts 19*a* and 19*b* of the forward-backward reversing switch 19 are closed, as a result of which its switching path is put through to backward operation. During this movement of the plate 18E, the pulse gear 11E remains at rest due to the relative play permitted between the gear and the drive shaft 10. The contact spring 35E, which seats against the insulating peripheral part 37 of the still-resting pulse gear 11E, is also shifted simultaneously with the indexing plate 18E in such a way that the tip 35*a* of the contact spring 35E is rotated away somewhat from the contact surface 34 that subsequently is to be guided into engagement past it. In case of further rotation of the turning knob, the pulse gear 11E is turned counterclockwise out of the stop position, whereby the stop spring 31 after exceeding the highest point of a stop tooth will likewise accelerate the rotatory movement of the pulse gear 11 because of the possible play. As a result, one contact surface 34 is rotated past and against the contact spring 35E in an accelerated manner and an only short time pulse transmission will be achieved. This pulse is then passed onto the indicator in the same manner as in the case of the embodiment according to FIG. 6*a.* During movement of the gear 11E, the plate 18E can remain stationary due to its frictional mounting arrangement.

As soon as the pulse gear 11E is fixed in the next stop position and no further outside shifting forces are applied to the transmission gear, the indexing plate 18E, and the gear 11E are swiveled by the tension spring 20 into the position for forward operation of the indicator, shown in FIG. 7*a,* whereby the two contacts 19*a* and 19*b* of the forward-backward reversing switch 19 are again opened and the switching path is again put through for a forward operation.

The function of the arrangement, shown in FIG. 7*c,* corresponds largely to that of the arrangement according to FIG. 7*a.* The introduction of force from the turning knob, however, in this case takes place not via a transmission gear but directly to the indexing plate 18E and the pulse gear 11E.

In the case of the arrangements of FIGS. 9 and 10, the type of recording that is to be adjusted in each case, e.g., the waking up time (FIG. 9) should be preselected prior to operation of the pulse gear 11 (or of the contact spring 35') by way of the one or several corresponding signal paths and recording reversing switches. After completion of the pertinent adjusting process for the indicator, the recording arrangement is again switched back to a current presentation for the time of day by reversing all reversing switches.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. In an electric instrument of the type which includes a digital indicator and first pulse generating means electrically connected to said digital indicator for normally continually operating said digital indicator, an electromechanical digital indicator adjustment means including a second pulse generator actuable by a manually operable operating member for adjusting said digital indicator, said second pulse generator comprising:

means for producing electric pulses connectable electrically to said digital indicator for supplying such pulses thereto;

sensor means operably connectable to said pulse producing means to deliver activating signals thereto for the production of electrical pulses; and a pulse control member including a plurality of pulse-producing elements arranged in a circular path and operably associated with said sensor means to control the delivery of activating signals to said pulse producing means;

one of said sensor means and said pulse control member being rotatable relative to the other at selective speeds by said manually operable operating member such that activating signals are generated in response to such relative rotation and are generated at a rate proportional to the relative rotational speed between said pulse control member and said sensor means.

2. An instrument according to claim 1 wherein said pulse control member comprises a stationary body having a plurality of spaced electrical contact surfaces; said sensor means being rotatable and including a contact spring biased into engagement with said stationary body and operable, when rotated, to sequentially contact said contact surfaces; said contact spring and said contact surfaces forming part of an electric circuit connected to said pulse producing means such that rotation of said spring into sequential engagement with said contact surfaces intermittently closes said circuit to intermittently activate said pulse producing means.

3. An instrument according to claim 1 wherein said pulse control member is rotatable and carries a plurality of spaced electrical contact surfaces; said sensor means including a stationary spring biased toward said pulse control member and operable, when said pulse control member is rotated, to sequentially contact said contact surfaces; said spring and said contact surfaces forming part of an electrical circuit connected to said pulse producing means such that engagement of said spring with each contact surface closes said circuit and activates said pulse producing means to adjust said digital indicator.

4. An instrument according to claim 1 wherein said sensor means comprises a light source and a photoelectric cell connected electrically to said pulse sensor; said pulse control member comprising a rotatable perforated disc having holes therethrough arranged in a circular array such that rotation of said disc intermittently communicates light between said light source and said cell to activate said pulse sensor.

5. An instrument according to claim 3 wherein said pulse control member comprises a wheel having an insulative portion and a conductive portion molded therein as a laminate; said conductive portions including radially projecting legs forming said contact surfaces.

6. An instrument according to claim 5 further including a conductive contact spring continuously engaging said conductive portion and forming a part of said electric circuit.

7. An instrument according to claim 1 wherein said pulse control member is rotatable and comprises a gear having projections about its outer periphery, said sensor means including a movable arm contacting said gear periphery and signal producing means connected to said arm for producing electrical signals to actuate said pulse producing means in response to movement of said arm by said projections during rotation of said gear.

8. An instrument according to claim 7 wherein said projections comprise arc-shaped cams; said arm comprising a metallic leaf spring whose free end engages the outer periphery of said gear and is deflectable by said cams during rotation of said gear.

9. An instrument according to claim 7 wherein said arm comprises a leaf spring whose free end contacts, and is deflectable by, said projections; said signal producing means comprising a piezoelement electrically coupled to said pulse sensor and which is stimulated in response to deflection of said spring to actuate said pulse producing means.

10. An instrument according to claim 7 wherein said signal producing means comprises a core movably mounted within a coil connected electrically to said pulse producing means, and means creating a magnetic field therethrough; said arm being coupled to said core to create an electric signal in said coil in response to movement of said arm.

11. An instrument according to claim 10 wherein said armature comprises an iron core mounted on a conductive yoke plate; said magnet field generating means comprises a permanent magnet mounted on said yoke plate; said arm comprising a metallic leaf spring whose free end engages said projections and is deflectable by said projections in response to rotation of said gear to generate an electric signal in said coil.

12. An instrument according to claim 1 wherein said stop means comprises a toothed element mounted on said pulse control member and a stop spring engageable with recesses between successive teeth; said recesses each corresponding in location to a position of said pulse control member wherein no electrical adjusting signal is generated.

13. An instrument according to claim 12 including a rotary drive shaft on which said pulse control member is drivably mounted, with a limited amount of rotary play, enabling said stop spring to rotatably advance said pulse control member relative to said drive shaft once the peak of the next stop tooth has passed said stop spring.

14. An instrument according to claim 1 wherein said sensor means comprises an electrically conductive spring member which is rotatable in contact with said pulse control member to intermittently contact spaced conductive contact surfaces on said pulse control member to activate said pulse producing means; said pulse control member including indentations disposed between said conductive contact surfaces into which said spring engages to resist further rotation of said spring.

15. In an electric instrument, such as a timepiece, which includes a digital indicator, first pulse generating means electrically connectable to said digital indicator for normally continually operating said digital indicator, and a second pulse generator electrically connectable to said digital indicator for adjusting said digital indicator, said second pulse generator comprising:

a pulse former connectable electrically to said digital indicator for supplying electrical adjusting pulses thereto;

sensor means operably connectable to said pulse former to deliver activating signals thereto for the production of an adjusting pulse;

a pulse control member operably associated with said sensor means to control the delivery of activating signals to said pulse former;

one of said sensor means and said pulse control member being rotatable relative to the other such that activating signals are generated in response to such relative rotation and are generated at a rate proportional to the rotational speed of said pulse control member; and a forward-backward reversing switch electrically connected between said pulse former and said digital indicator, said switch including a switching element which is mounted for rotation along with the rotatable one of said pulse control member and said sensor means to regulate the direction of adjustment of said digital indicator in accordance with the direction of rotation of said pulse control member.

16. An instrument according to claim 15 wherein said reversing switch further includes yieldable means for normally biasing said leg against said first stop.

17. An instrument according to claim 15 wherein said pulse control member is rotatable; said switching element comprising an indexing plate mounted frictionally for rotation coaxially with said pulse control member; said indexing plate including an extension leg and being rotatable between a first stop position wherein said leg contacts a first electric contact for effecting forward adjustment of said digital indicator and a second stop position wherein said leg contacts a second electric contact for effecting backward adjustment of said digital indicator.

18. An instrument according to claim 1 wherein said pulse control member is rotatable; said second pulse generator further includes a forward-backward reversing switch electrically connected between said pulse former and said digital indicator, said switch including an indexing plate which is mounted coaxially with said pulse control member and is frictionally driven rotatably therewith; said indexing plate being rotatable between a first stop position for effecting forward adjustment of said digital indicator and a second stop position for effecting backward adjustment of said digital indicator; said pulse control member carrying a plurality of spaced electrical contact surfaces; said sensor means comprising a contact spring carried by said indexing plate and being biased toward said pulse control member to sequentially contact said contact surfaces when said pulse control member is rotated relative to said indexing plate; said contact spring and said contact surfaces forming part of an electric circuit connected to said pulse producing means such that engagement of said spring with each contact surface closes said pulse producing means to adjust said digital indicator; the distance of rotational movement of said indexing plate between said first and second stop positions being less than but greater than one-half the distance between successive ones of said contact surfaces; a toothed stop wheel being mounted for rotation with said pulses control member; a stop spring biased into engagement with recesses between successive teeth to resist rotation of said pulse control member; said recesses each corresponding in location to a position of said pulse control member in which no electrical adjusting signal is generated; said pulse control member and said indexing plate being rotatably driven by a drive shaft; there being limited rotational play between said pulse control member and said drive shaft to enable said indexing plate to be rotated relative to said pulse control through a limited angle and to enable said stop spring to rotatably advance said pulse control member relative to said drive shaft once the peak of the next stop tooth has passed said stop spring.

19. An instrument according to claim 1 including a housing around said second pulse generator; said pulse control member connected to said manually operable member through an opening of a housing wall of said housing to be accessible for manual rotation.

20. An instrument according to claim 1 including a housing around said second pulse generator; said pulse control member being drivably mounted on a drive shaft; said drive shaft projecting through an opening of a wall of said housing; said manually operable member comprising a turning knob operably connected to said drive shaft and accessible externally of said housing to afford manual rotation of said shaft.

21. An instrument according to claim 20 wherein said knob is mounted on an auxiliary shaft, first and second gears mounted on said drive shaft and said auxiliary shaft, respectively, said gears being in mesh, with a limited amount of play, to transmit rotation from said knob to said driving shaft.

22. An instrument according to claim 20 including a motor connected to an auxiliary shaft, first and second gears mounted on said drive shaft and said auxiliary shaft, respectively, said gears being in mesh, with a limited amount of play to transmit rotation from said motor to said driving shaft.

23. An instrument according to claim 1 wherein said instrument comprises an electronic timepiece.

24. An instrument according to claim 23 including an alarm system.

25. An instrument according to claim 1 wherein said instrument comprises an electric timer switch.

26. An instrument according to claim 28 and further including a seconds counter connected in series with said frequency divider, said signal path reversing switch having first and second inlets, the outlet of said seconds counter being connected to the first inlet of said signal path reversing switch; the outlet of said pulse producing means being connected to the second inlet of said signal path reversing switch; an outlet of said signal path reversing switch being connected to the inlet of a forward-backward reversing switch for selecting the direction of adjustment of said digital indicator; said minutes counter being connected in series with the outlet of said forward-backward reversing switch; said hours counter being connected in series with said minutes counter.

27. An instrument according to claim 26 wherein said first inlet of said signal path reversing switch constitutes the first inlet of a first AND gate; the second inlet of said AND gate being connected to an inverter; said inverter being connected to the first input of a second AND gate; the second inlet of the signal path reversing switch constituting the second inlet of said second AND gate; a switching-delaying circuit being electrically connected between the two inlets of said second AND gate; the outputs of said first and second AND gates being connected to the inlets of an OR gate; the outlet of said OR gate constitutes said outlet of said signal path reversing switch and is connected to said forward-backward reversing switch.

28. An instrument according to claim 23 comprising an electronic timepiece, said first pulse generating means includes a frequency standard, a frequency divider, an hour counter, a minute counter, a signal path reversing switch for selectively connecting said first and second pulse generating means to said digital indicator; and a decoder connected in series with said counters.

29. An instrument according to claim 28 wherein said electric timepiece includes an alarm system; a second signal path reversing switch connected to said second pulse generating means; a storage element connected to said second signal path reversing switch so that a waking-up signal from the latter can be stored in said storage element; a recording-reversing switch connected to said storage element to enable the stored signal to be selectively displayed on said digital indicator instead of the time of day; a comparator being connected to said counters for the time of day and to said storage element for comparing the stored wake-up time with the time of day; said comparator being connected to said alarm mechanism.

30. An instrument according to claim 28 wherein said first pulse generating means includes a frequency standard, a frequency divider, an hour counter, a minute counter, a signal path reversing switch for selectively connecting said first and second pulse generating means to said digital indicator; and a decoder connected in series with said counters; a second signal path reversing switch connected to said second pulse generating means; a first storage element connected to said second signal path reversing switch so that the start or finishing time for completing an operation can be stored in said first storage element by said second pulse generating means; a comparator having inlets connected to said first storage element and to a counter of said first pulse generating means; a third signal path reversing switch connectable to said second pulse generating means and to a second storage element so that the duration of the function can be stored by means of the second pulse generating means; said third reversing switch being connected to a counter of said first pulse generating means and to the outlet of said comparator so that agreement between the time of day and the time stored in said first storage element caused a time of day signal to be supplied to said second storage element; and to a switch for activating a function; said second storage element being connectable to said digital indicator by means of a fourth reversing switch; said second storage element being operable to deliver a signal to an alarm mechanism at the conclusion of the time duration stored therein.

31. An instrument according to claim 1 including counter means, and further comprising a first storage element connected in series with said second pulse generating means and being operable to store a theoretical value; said first storage element being connected to said digital recorder to display the theoretical value thereon; a second storage element for storing an actual value; a second digitial indicator; said second storage element being connected thereto to display the actual value thereon; a comparator connected to said first and second storage elements which, when said theoretical and actual values are in agreement, is operable to deliver a switching signal.

32. An instrument according to claim 1 including a plurality of time counters connected to said digital indicator; said counters comprising forward-backward counters; and a reversing switch connected between said second pulse generating means and said counters for selecting a forward or backward mode of adjustment.

33. An instrument according to claim 1 including stop means for holding the sensor means between two adjacent pulse-producing elements of the pulse control member when said second pulse generator is not being actuated.

34. An instrument according to claim 1 wherein said second pulse generator further includes a reversing switch electrically connected between said pulse former and said digital indicator, said switch including a switching element which is mounted for rotation along with said rotatable one of said pulse control member and said sensor means to regulate the direction of adjustment of said digital indicator in accordance with the direction of rotation of said pulse control member.

* * * * *